US006099382A

United States Patent [19]

Wilson

[11] Patent Number: 6,099,382

[45] Date of Patent: Aug. 8, 2000

[54] SPORTS BRASSIERE

[75] Inventor: Collette Wilson, Allen, Tex.

[73] Assignee: HKK Enterprises, Inc., Alpine, Calif.

[21] Appl. No.: 09/363,432

[22] Filed: Jul. 28, 1999

[51] Int. Cl.[7] ..... A41C 3/00

[52] U.S. Cl. ..... 450/89; 450/1; 2/247

[58] Field of Search ..... 450/1, 58, 36, 450/89; 2/247–249

[56] References Cited

U.S. PATENT DOCUMENTS

| | | | |
|---|---|---|---|
| 2,352,866 | 7/1944 | Stacy . | |
| 2,436,430 | 2/1948 | Hart | 450/1 |
| 2,610,325 | 9/1952 | Schlussel | 450/89 |
| 2,624,881 | 1/1953 | Lee | 450/1 |
| 3,078,852 | 2/1963 | Stapleton | 450/89 |
| 3,565,081 | 2/1971 | Barg | 450/1 |
| 3,997,921 | 12/1976 | Knight . | |
| 4,168,544 | 9/1979 | Kallman . | |
| 4,174,717 | 11/1979 | Schreiber et al. . | |
| 4,311,150 | 1/1982 | Schreiber et al. . | |
| 4,583,544 | 4/1986 | Flanagan et al. . | |
| 4,666,432 | 5/1987 | Mcneish et al. | 450/1 |
| 4,896,377 | 1/1990 | Ferdi . | |
| 4,917,651 | 4/1990 | Rainville . | |
| 5,067,178 | 11/1991 | Katchka . | |
| 5,119,979 | 6/1992 | Kallman . | |
| 5,496,205 | 3/1996 | Lee | 450/89 |
| 5,584,074 | 12/1996 | Battle-Smith . | |

*Primary Examiner*—Gloria M. Hale
*Attorney, Agent, or Firm*—Fulbright & Jaworski L.L.P.

[57] ABSTRACT

A sports brassiere constructed of stretchable material and formed to have a torso-encircling member having a front and rear portion. The front portion supports a liner member positioned against the breasts of the wearer with a pocket carried by the liner member and positioned substantially between the breasts of the wearer so as to be easily reachable by the wearer. A strip of stretchable material is affixed to the rear portion of the torso-encircling member and is affixed at each of its ends to the body portion so as to provide a strap or loop. The pocket and the loop provide means to carry articles desired by the wearer.

19 Claims, 2 Drawing Sheets

FIG. 1
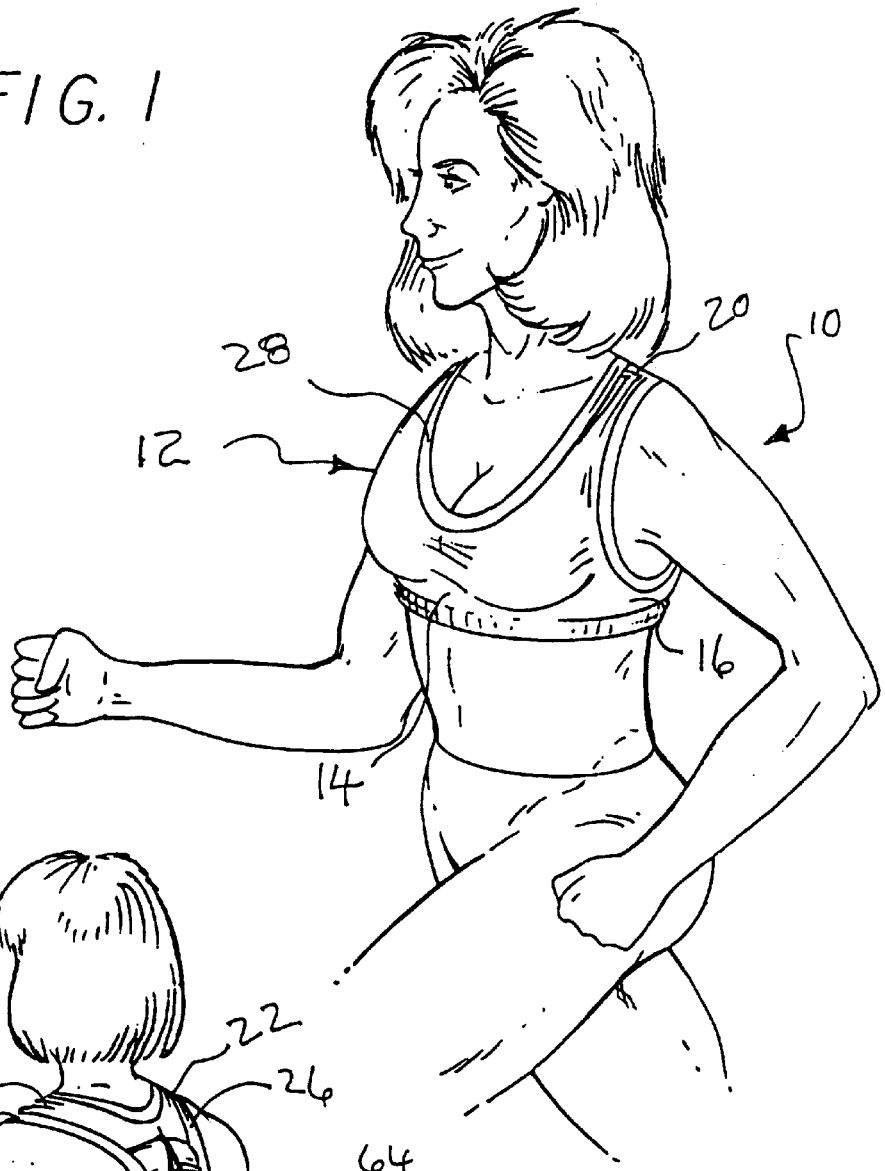
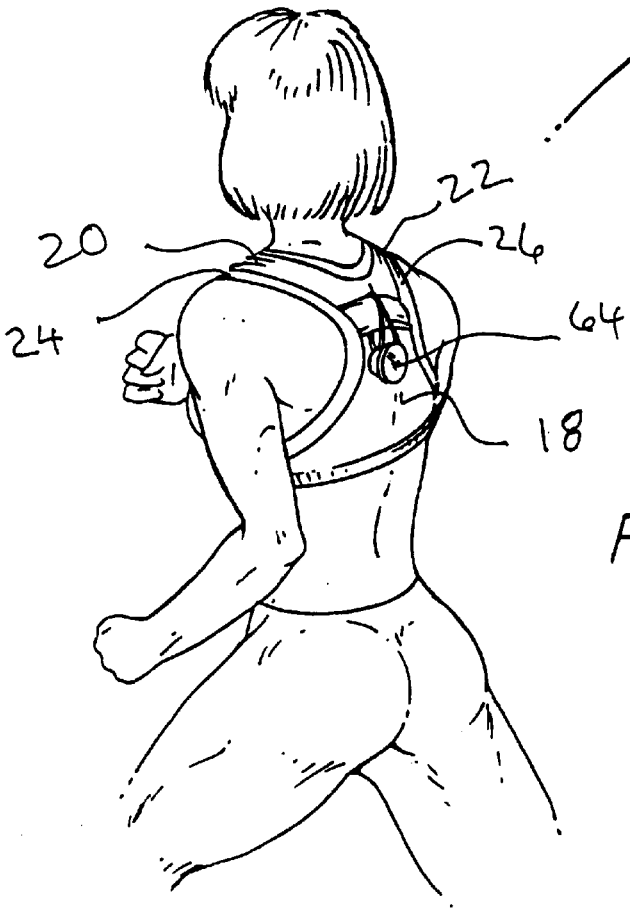
FIG. 2

SPORTS BRASSIERE

BACKGROUND OF THE INVENTION

The present invention relates generally to the art of garment construction and more particularly to brassieres constructed for wear during sporting events and other leisure time activities.

Women are competing more in sporting events and in leisure time activities which require vigorous movement of the body. Such movement causes the breasts to move up and down and/or side to side as a result of the physical activity. Such movement of the breasts, depending on the construction of the brassiere worn, can render extreme discomfort to the wearer as a result of various areas of chafing and irritation. Thus, the construction of brassieres to be used during such times of competing in sporting events or in leisure time activities has become increasingly more important.

As a result, the construction of brassieres to be used in sporting and leisure time activities have been designed without cups and act generally to bind the breasts against the body during such activities. Typical of such prior art sports brassieres are those illustrated in U.S. Pat. Nos. 4,174,717; 4,311,150 and 4,583,544. Although such prior art sports brassieres result in providing firm support for the breasts by binding the breasts against the body and in some-instances avoid some of the irritation and chafing experienced as a result of areas of stitching to form the brassiere, such prior art structures still produce chafing and irritation to the breasts of the wearer as the breasts move during the vigorous physical activity.

In addition to the comfort of the wearer, it is desirable to provide article carrying means which can be utilized by a woman competing in such sporting events or leisure time activity. For example, it is desirable to be able to carry a credit card, money, identification, or similar such articles as well as security devices such as flashers, cellular telephones and the like, which may be used by the woman for protection and calling for assistance should such be necessary. Although the prior art does disclose various types of brassieres having pockets formed therein for various purposes, none of such prior art brassieres are capable of being used in sporting events or leisure time activity. Examples of such prior art brassieres are shown in U.S. Pat. Nos. 2,436,430; 2,610,325; 2,624,881; 3,078,852; 3,565,081 and 5,496,205.

Other garments have been provided which include article-carrying members such as pockets or loops and examples of such articles are shown in U.S. Pat. Nos. 4,168,544; 4,896,377; 5,067,178 and 5,584,074.

Although various prior art structures include brassieres having pockets therein and other articles of clothing having pockets and loops or straps for carrying other articles, Applicant is unaware of any existing sports brassiere or similar apparel article which is constructed to eliminate chafing and irritation of the breasts during the vigorous movement required in sporting events and other leisure type activities, such as jogging and running, as well as providing article carrying means as an integral part thereof which article-carrying means being in the form of a pocket to receive such items as a credit card, money, an identification document and the like, as well as an external flap or loop for carrying such items as a flasher, cellular telephone or the like for security and protection.

SUMMARY OF THE INVENTION

In accordance with the present invention, there is provided a sports brassiere which includes a torso-encircling member having a front portion for covering and supporting the breasts of the wearer and having a liner member disposed inside of and supported by the front portion of the brassiere against the breasts of the wearer to eliminate chafing and irritation and further includes an article-carrying means disposed on the brassiere.

In accordance with the more specific aspect of the present invention, the article-carrying means includes a pocket carried by the liner member and, more specifically, the pocket is formed integrally with the liner member and is disposed in a position so that it is open towards the top of the front portion of the brassiere so as to be easily reached by the wearer. In accordance with another and more specific aspect of the present invention, the article-carrying means may include a strip of stretchable material affixed at opposite ends thereof to a region of the brassiere approximately where shoulder straps and the rear portion of the torso-encircling member converge to provide a loop-type structure for receiving a flasher, cellular telephone or the like disposed so that the user may easily reach it if necessary.

BRIEF DESCRIPTION OF THE DRAWINGS

FIG. 1 is a perspective view from the front left of an individual wearing a sports brassiere constructed in accordance with the principles of the present invention;

FIG. 2 is a perspective view from the left rear of the individual depicted in FIG. 1;

DESCRIPTION OF THE INVENTION

Figure 3:
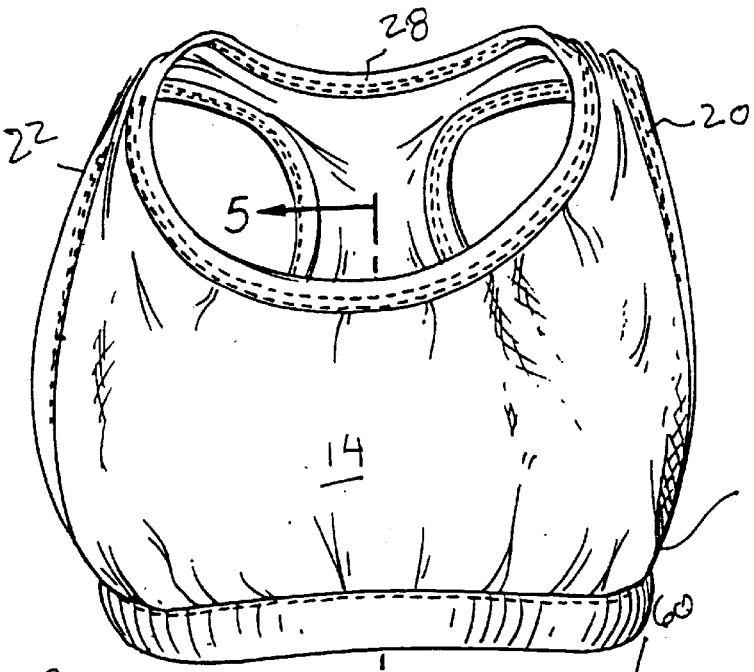
FIG. 3 is a front elevational view of the sports brassiere constructed in accordance with the principles of the present invention.

A sports brassiere constructed in accordance with the principles of the present invention is illustrated in FIGS. 1–5 to which reference is hereby made. Although the illustration is to a specific type of sports brassiere, it will be recognized by those skilled in the art that the article of wear may take many forms without departing from the scope or spirit of the invention as defined in the claims appended hereto. For example, the supporting portion of the article, which is illustrated in the form of a brassiere, may in fact be the upper portion of leotards or a similar body-covering garment which would include the liner and the easy reach pocket. As hereinafter defined, the invention may also be incorporated in a bodyshirt which is worn with tights wherein the bodyshirt would include the liner and the easy reach pocket. In addition, the brassiere structure itself may be modified to reduce the size of the torso encircling portion, thereby providing more emphasis to the shoulder straps and necessitating repositioning of the article-carrying strap or loop as hereinafter defined. The term "sports brassiere" as used herein including the claims shall be construed to include the foregoing items.

As is illustrated in FIG. 1, a wearer 10 of the sports brassiere 12, constructed in accordance with the present invention, is shown. The sports brassiere 12 includes a front portion 14 of a torso-encircling member 16. The front portion 14 covers and supports the breasts of the wearer 10. As is shown in FIG. 2, the sports brassiere also includes a rear portion 18 of the torso-encircling member 16. A pair of shoulder straps 20 and 22 extend from the torso-encircling member 16 and, more specifically, interconnect between the front portion 14 and the rear portion 18 thereof. The edges of the shoulder straps are covered by elastic bands 24, 26 and 28.

Affixed to the lower portion of the torso-encircling member 16 is a continuous elastic band 30 which is surrounded by the fabric from which the torso-encircling member 16 is formed. The continuous elastic band 30 assists in holding the brassiere in place during the movements of the wearer 10 while involved in various sporting activities. The front and rear portions 14 and 18 of the torso-encircling member 16 are formed continuously of a two-way stretchable fabric which holds the breasts firmly against the body, thus preventing excessive upward and downward movement of the breasts so as to avoid or minimize fatigue and muscle strain, which might otherwise be experienced. It should be evident from the illustrations that the brassiere constructed in accordance with the present invention has no cup-forming members as do traditional brassieres. The front portion 14 of the torso-encircling member 16 provides support for the breasts but the construction acts to bind the breasts against the body rather than moulding or shaping them.

Figure 4:
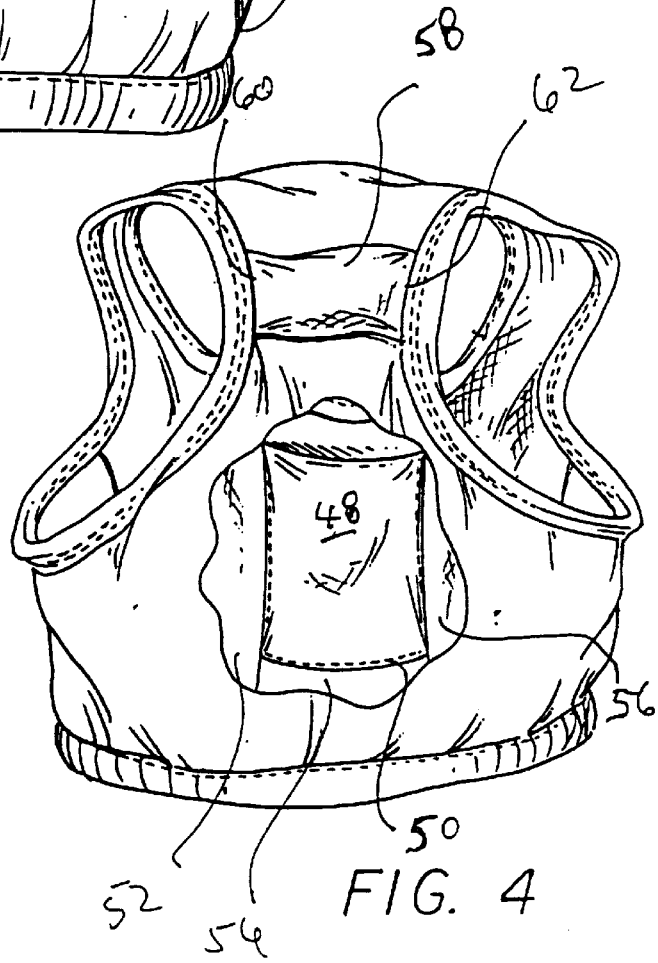
FIG. 4 is a rear elevational view thereof with a part of the rear portion thereof broken away to illustrate the easy reach pocket.
Figure 5:
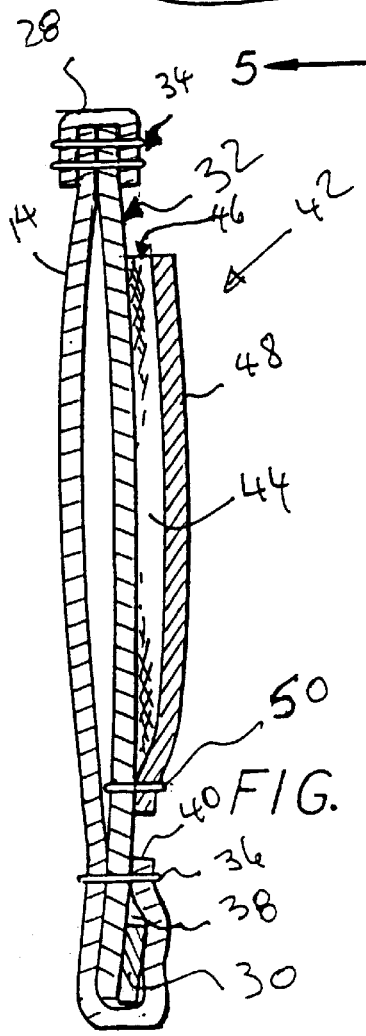
FIG. 5 is a cross-sectional view taken about the lines 5—5 of FIG. 3.

As is more clearly illustrated in FIGS. 4 and 5, a liner member 32 is disposed inside of the front portion 14 of the torso-encircling member 16. The liner member 32 is also formed from two-way stretchable material and preferably the material is much finer in texture than is the torso-encircling member 16, so as to provide a smooth and soft texture to engage the breasts of the wearer 10 to eliminate chafing and irritation, which could otherwise possibly occur during movement of the breasts occasioned by a sports activity engaged in by the wearer 10. Preferably the liner member 32 is held in place by stitching 34 and 36. As is shown, the stitching 34 secures the edge band 28 to the front portion 14 of the torso-encircling member 16 and at the same time secures the upper portion of the liner member 32 to the front portion 14. The stitching 36 retains the continuous elastic band 30 within a pocket 38 formed by turning the lower edge 40 of the front portion under and up. In addition, the stitching 36 also secures the lower edge of the liner member 32 to the front portion 14 of the torso-encircling member 16.

An article-carrying means 42, such as a pocket 44 having an upwardly directed opening 46, is formed so as to be carried by the sports brassiere in accordance with the present invention. Preferably, the pocket 44 is formed from a separate panel 48 of stretchable material which is stitched to the liner member 32 as illustrated by the stitches 50.

As is more clearly illustrated in FIG. 4, the panel 48 of material is disposed substantially centrally on the front portion 14 in such a manner that it is positioned between the breasts of the wearer 10 with the opening 46 disposed upwardly so as to be easily reachable by the wearer 10. The panel 48 is affixed to the liner member 32 and is of sufficient size to receive and retain in place such items as credit cards, identification material, money, keys, or the like, which the wearer 10 desires to carry during the physical exercise, such as running, jogging, sports activities or the like. As is also illustrated in FIG. 4, the liner member 32 may be constructed of three separate panels 52, 54 and 56 of the same stretchable material which are stitched together. The separate panel 48 of material forming the pocket 44 is positioned in such a manner as to be stitched over the central panel 54 of material and held in place as the stitching is accomplished to secure the three panels 52, 54 and 56 together. Such stitching is shown generally at 50 and as noted extends along the lower edge and the two side edges of the separate panel 48, thus retaining the upper part of the separate panel 48 unattached and open to receive objects as above described.

As is also illustrated in FIGS. 2 and 4, the article-carrying means may also include a strip of stretchable material 58 having opposite ends 60 and 62 which are secured to the rear portion 18 of the torso-encircling member 16. In accordance with the preferred embodiment of the present invention, the opposite ends 60 and 62 are secured in place by stitching and preferably by inserting the edges inside the elastic edge bands 20 and 22 at the time they are stitched onto the torso-encircling member 16. The strip of stretchable material 58 thus is not attached to the torso-encircling member 16 other than at the edges 62 and 60. As a result, the straplike section or loop formed by the strip of stretchable material 58 can be utilized to support some type of device 64 desired by the wearer 10. For example, the device 64 may be a cellular telephone, a flasher which intermittently provides a light to warn approaching traffic of the existence of the runner, or a similar type of structure. Other articles as desired may also be held by the strip of material 58 in such a manner that they do not interfere with the activity of the wearer 10 but yet provide easy access by the wearer 10 to the article 64 whatever it may be. As is illustrated particularly in FIGS. 2 and 4, the strip of stretchable material 58 is positioned approximately at the region where the shoulder straps 20 and 22 and the rear portion 18 of the torso-encircling member 16 converge. The strip of stretchable material 58 may be positioned upwardly or downwardly on the rear portion and may have the ends thereof attached to the rear portion by directly stitching to it as opposed to being positioned under the bands 20 and 22.

What is claimed is:

1. A sports brassiere comprising:

(A) a torso-encircling member having a front portion for covering and supporting the breasts of a wearer;

(B) a liner member disposed inside of and supported by at least a part of said front portion;

(C) said torso-encircling member and said liner member are each made from stretchable fabric with said liner member being more stretchable than said torso-encircling member; and (D) a pocket carried by said liner member.

2. A sports brassiere as defined in claim 1, which further includes shoulder straps extending from said torso-encircling member.

3. A sports brassiere as defined in claim 2, wherein said pocket is formed integrally with said liner member.

4. A sports brassiere as defined in claim 3, wherein said pocket is open toward the top of said front portion so as to be easily reached by the wearer.

5. A sports brassiere as defined in claim 3, wherein said liner member is secured to said front portion by stitching the periphery thereof and said pocket is disposed substantially centrally of said front portion between the breasts of the wearer.

6. A sports brassiere as defined in claim 3, wherein said pocket is formed from a separate panel of stretchable material stitched to said liner member.

7. A sports brassiere as defined in claim 6, wherein said separate panel is positioned on said liner member to be adjacent the body of the wearer.

8. A sports brassiere comprising:

(A) A torso-encircling member having a rear portion and a front portion for covering and supporting the breasts of the wearer;

(B) shoulder straps extending from said torso-encircling member at the rear and front portions thereof; and (C) an article supporting member affixed to said brassiere at approximately where said shoulder straps and the rear portion of said torso encircling member converge.

9. A sports brassiere as defined in claim 8, wherein said article supporting member is a strip of stretchable material having first and second ends, said strip of stretchable material being secured at each of said ends only to said converging region.

10. A sports brassiere as defined in claim 9, wherein said torso-encircling member and said shoulder straps are formed integrally and said strip of stretchable material is stitched to said converging region.

11. A sports brassiere comprising:

(A) a torso-encircling member having a rear portion and a front portion for covering and supporting the breasts of the wearer;

(B) shoulder straps extending from said torso-encircling member at the rear and front portions thereof;

(C) a liner member disposed inside of and supported by at least a part of said front portion;

(D) a pocket carried by said liner member; and (E) an article supporting member affixed to said brassiere at approximately where said shoulder straps and the rear portion of said torso encircling member converge.

12. A sports brassiere as defined in claim 11, wherein said torso-encircling member and said liner member are each made from stretchable fabric with said liner member being more stretchable than said torso-encircling member.

13. A sports brassiere as defined in claim 11, wherein said pocket is formed integrally with said liner member.

14. A sports brassiere defined in claim 12, wherein said pocket is open toward the top of said front portion so as to be easily reached by the wearer.

15. A sports brassiere as defined in claim 13, wherein said liner member is secured to said front portion by stitching the periphery thereof and said pocket is disposed substantially centrally of said front portion between the breasts of the wearer.

16. A sports brassiere as defined in claim 14, wherein said pocket is formed from a separate panel of stretchable material stitched to said liner member.

17. A sports brassiere as defined in claim 15, wherein said separate panel is positioned on said liner member to be adjacent the body of the wearer.

18. A sports brassiere as defined in claim 16, wherein said article supporting member is a strip of stretchable material having first and second ends, said strip of stretchable material being secured only at each of said ends to said converging region.

19. A sports brassiere comprising:

(A) a torso-encircling member having a front portion covering and supporting the breasts of a wearer;

(B) a liner member disposed inside of and supported by at least a part of said front portion; and (C) a pocket formed on said liner member and disposed between said torso encircling member and said wearer and having an opening accessible only from the top and inside of said brassiere.

* * * * *